US005487254A

United States Patent [19]

Dronsfield

[11] Patent Number: 5,487,254

[45] Date of Patent: Jan. 30, 1996

[54] APPARATUS FOR INSERTING MATERIAL INTO ENVELOPES

[75] Inventor: David M. Dronsfield, Loughton, Great Britain

[73] Assignee: Printed forms Equipment Limited, Loughton, Great Britain

[21] Appl. No.: 178,987

[22] Filed: Jan. 7, 1994

Related U.S. Application Data

[62] Division of Ser. No. 915,694, filed as PCT/GB91/00105, Jan. 24, 1991, Pat. No. 5,327,701.

[30] Foreign Application Priority Data

Jan. 25, 1990 [GB] United Kingdom ..... 9001758

[51] Int. Cl.[6] ..... B65B 43/38

[52] U.S. Cl. ..... 53/381.7; 53/381.5

[58] Field of Search ..... 53/381.7, 381.5, 53/492, 468; 493/465, 453, 245

[56] References Cited

U.S. PATENT DOCUMENTS

| | | | |
|---|---|---|---|
| 3,474,711 | 10/1969 | Swinyar | 53/381.7 X |
| 3,935,800 | 2/1976 | Sette et al. | 53/381.7 X |
| 3,974,749 | 8/1976 | Luperti et al. | 53/381.7 X |
| 5,112,291 | 5/1992 | VerMehren | 53/381.7 X |
| 5,156,585 | 10/1992 | Dimur et al. | 53/381.7 X |

*Primary Examiner*—James F. Coan

*Attorney, Agent, or Firm*—Jon Carl Gealow; Keck, Mahin & Cate

[57] ABSTRACT

An envelope opening apparatus is provided which conveys envelopes with envelope flap fold lines parallel to the direction of conveyance toward distortion means and restraining means in the path of conveyance which distortion means partially opens the envelope, and which envelope is further conveyed to a device which completes the opening of the envelope in preparation for inserting material into the envelope.

7 Claims, 4 Drawing Sheets

APPARATUS FOR INSERTING MATERIAL INTO ENVELOPES

This application is a division of U.S. Application Ser. No. 07/915,694, filed as PCT/GB92/00105, Jan. 24, 1991, now U.S. Pat. No. 5,327,701.

DESCRIPTION

The invention relates to drive adjustment device for inserter apparatus, that is, an apparatus for effecting insertion of desired insert material into each of a series of envelopes.

Such apparatus comprises conveyor means defining a flow path along which envelopes are conveyed successively from a stack or other supply source through an opener station, at which each envelope is opened, to an insert station at which desired insert material, comprising one or more items usually in the form of printed cards or sheets, which may or may not be folded, is placed inside each opened envelope. The filled or loaded envelope is then usually conveyed from the insert station to be closed and sealed if required. Where the insert material is to comprise a plurality of items, a second conveyor means can be provided along which the two or more insert items are assembled into a stack, as by depositing on each first item the or each additional item from separate feeder devices, some or all of which can include folding equipment, located side-by-side along the flow path provided by the second conveyor means. This path ends at the insert station, where each assembled stack is loaded into a respective envelope carried there by the first-mentioned conveyor means.

Apparatus of this kind is required to operate quickly and reliably. It should be capable of detecting immediately any misfeed of the envelopes and insert material and is desirably simple in construction, incorporating as few moving parts as possible. It should also be readily adjustable to accommodate envelopes of different sizes. The invention is accordingly concerned with the provision of an inserter apparatus incorporating improved arrangements for the handling of the envelopes and the insert material, for detection of operational failure, and for adjustment to a selected envelope size.

The invention, more specifically, provides in such apparatus improved means for effecting opening of envelopes moved along a first flowpath to an insert station, improved means for assembling together a stack of inserts along a second flow batch leading to the insert station, improved means for detecting failure of insert material to enter into an envelope, and improved means for adjustment according to envelope size.

The invention thus provides an inserter apparatus having conveyor means for conveying to an insert station a series of envelopes, and static means for effecting opening of envelopes being so conveyed prior to reaching the insert station. The static means comprises upstream means by which the envelope is distorted so as to cause an angular separation between the flap and the adjacent portion of the envelope body, and downstream means by which the flap is made to extend from the body in substantially co-planar relationship.

Thus, the envelopes can be moved by the conveyor means with the edge at which the closure flap joins the body of the envelope extending parallel to the direction of movement. The static means provides a guide restraining upward movement of this edge and a ramped ridge extending parallel to the edge, so as to be engaged by the underside of the envelope at a position somewhat laterally spaced from the edge, whereby the flap is raised upwardly from the body of the envelope. The envelope is carried further in this condition to bring the flap into engagement with a third element of the static means, a "ploughshare" or curved plate, by which the falp is brought substantially into the plane of the rest of the envelope, which has now moved beyond the downstream end of the ridge. The envelope is held in this opened condition at the insert station, ready to receive the insert material.

By the static envelope opening means of the invention, opening is reliably effected in an extremely economical way without moving parts other than the envelope itself, and of course the conveyor means by which it is moved.

The invention also provides an inserter apparatus having an insert station to which opened envelopes are successively carried and at which insert material is inserted into each envelope, the insert station having means of detection of a failed insertion operation responsive to the consequential distortion from planality of the material and/or envelope. The detector means thus has a detector element, conveniently a radiation beam, for example an infrared radiation beam, extending across the mouth of the envelope at a small distance thereabove, so as to be engaged or interrupted by the envelope and/or insert material should this become buckled as would occur if the insert material did not smoothly enter the envelope.

The invention also provides an inserter apparatus having an insert station to which opened envelopes are successively carried, pusher means for pushing insert material into each envelope, the pusher means incorporating a lost-motion connection operative on failure of insert material to enter an envelope, and detector means responsive to operation of the lost motion connection to detect a failed insertion operation. The pusher means can thus comprise a pusher element for engaging the insert material, movement of which in the inserting direction is effected by a drive element connected to the pusher element by a constant-force spring. If the pusher element is prevented from completing its insertion stroke, the spring allows the drive element to complete its normal cycle of operation. The detector means can again be conveniently constituted by an infra-red or other radiation beam which is energised at an appropriate time in the cycle to determine whether or not the pusher element has effected its normal movement. Alternatively, the position of the pusher element can be sensed electromechanically as by a suitably located micro-switch.

An inserter apparatus embodying the invention preferably includes both of the detector arrangements described above. The detector means output, on sensing of a defective insertion, is employed to stop operation of the apparatus and preferably also to indicate its condition by audible and/or visual alarm means.

The invention also provides an inserter apparatus shaving at least one assembly device for assembling into stacks for insertion into envelopes at least a plurality of inserts fed onto an insert conveyor by respective feeder devices, one or more of which may but need not include folding means for folding the inserts before they are fed onto the conveyor, the assembly means comprising a frame or cassette located over the conveyor and providing a receiving zone arranged to receive successive inserts from an associated feeder device, to locate each insert over one or more inserts already stacked on the conveyor, and to permit movement of the insert from the zone onto and with the one or more inserts. The receiving zone of the assembly device can be constituted by an upper guide inclined so as to deflect an insert from the feeder device downwardly onto a lower guide having a free downstream end so that a conveyor element driving the one or more inserts already on the conveyor can engage the insert in the zone and move it together with them from the zone to the next feeder device or to the station at which the insert stack is placed inside an envelope. The inserts from the or each upstream device are thus not fed directly onto the inserts on the conveyor already, but are drawn from receiving zones by the conveyor. Precise registration of the insert material in the stack is thus ensured.

The invention also provides an inserter apparatus comprising a conveyor having envelope carrier elements spaced along it at fixed intervals, for moving envelopes successively from a supply source through an envelope opening station to an inserter device by which insert material is placed inside each envelope, the conveyor being driven in co-ordination with the inserter device through a drive device permitting elective interruption of the drive to allow positioning of the carrier elements appropriate to the size of the envelopes to be loaded. The drive to the conveyor may thus be by way of a gear train including an idler gear which can be selectively moved between an engaged position in which drive from a motor is applied to the conveyor through the gear train and a disengaged position in which the drive is applied to the gear train but does not reach the conveyor. Such a drive can be very simply constructed and operated.

The invention is further described below, by way of example, with reference to the accompanying drawings, in which.

The apparatus illustrated comprises a frame supporting a work surface on which are moved envelopes, and insert material to be received in them, by conveyors engaging the envelopes and the insert material. The movement of the conveyors and of other work to be described is effected and co-ordinated by appropriate drive arrangement beneath the work surface which are largely conventional and which will accordingly be described only to the extent needed for an understanding of the invention.

Figure 1:
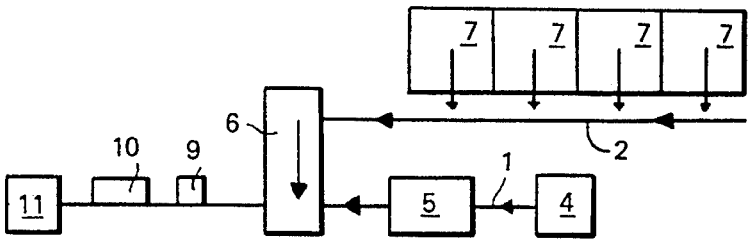
FIG. 1 is a simplefied schematic plan view illustrating the general layout of an inserter apparatus in accordance with the invention.
Figure 2A:
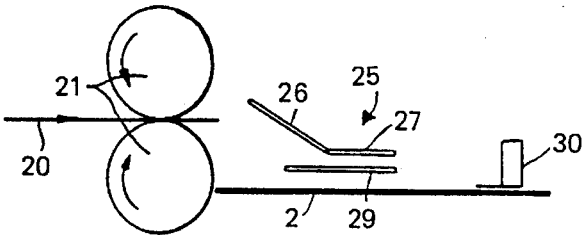
FIG. 2A is a partial schematic cross-sectional view through a cassette included in the apparatus of FIG. 1 for reception of an insert from a feeder.
Figure 2B:
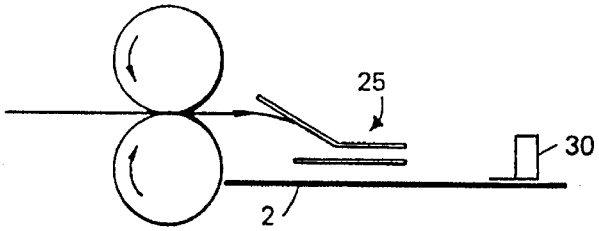
FIGS. 2B, 2C and 2D are views similar to FIG. 2A but showing successively later stages of the movement of the insert into the cassette.
Figure 2C:
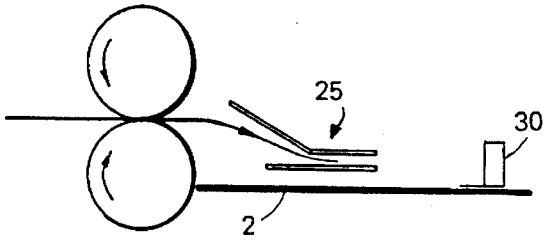
Figure 2D:
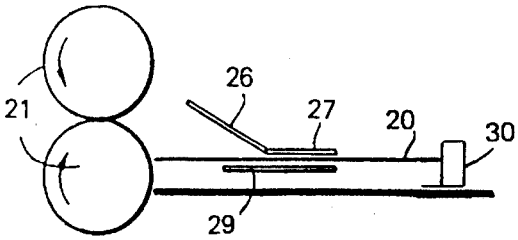

As schematically shown in FIG. 1, the apparatus has two conveyors 1,2 moving along parallel tracks. The first conveyor 1 successively feeds envelopes from beneath a stack of envelopes in a holder 4 located on the work surface through an opening station 5 at which the envelopes are opened so that each can receive insert material, usually a stack of printed sheets, at least some of which may be folded, at an insert station 6. The second conveyor 2 extends adjacent a row of insert feeders 7, each arranged to feed an insert onto the conveyor track, so that a stack of inserts is formed progressively along it. A completed stack of a desired number of inserts reaches the insert station 6 at the downstream end of the second conveyor track, where the assembled stack is transported laterally into an open envelope on the first conveyor track. The first conveyor 1 extends beyond the insert station 6 past a moistener 9 for moistening adhesive on the envelope flap and a closer 10 for closing the charged or loaded envelopes which are discharged by the conveyor from the apparatus or into a chute or receptacle 11 at the end of the track.

The second conveyor track, described in more detail, thus comprises a plurality of pusher elements carried on a driven conveyor chain loop and extending through a slot in the work surface. The inserts handled by the feeders 7 are of a size to be received within the envelopes, or the feeders comprise folding means whereby a larger sheet is folded to produce a folded insert of appropriate size. The feeders 7, with or without folders, can be of any suitable kind; their construction and operation form no part of the present invention and are sufficiently well known for further description not to be required. Any desired number of the feeders 7 can be employed.

As shown in FIGS. 2A, 2B, 2C and 2D, the insert feeders 7 each supply respective inserts 20 from a stack successively onto the second conveyor 2 from between a pair of eject rollers 21 for stacking onto any inserts from any upstream insert feeder or feeders. In accordance with the invention, this stack formation is effected by a cassette 25 arranged to guide the ejected inserted 20 into a receiving chamber located about the conveyor path from which it can be carried by the conveyor onto the work surface directly or onto one or more inserts already being carried by the conveyor. The cassette 25 accordingly comprises upper and lower plates, of which the upper plate has an inlet portion 26 inclined upwardly from a horizontal portion 27 towards the eject rollers 21. The portion 26 serves to deflect downwardly an insert 20 being fed out from the feeder (FIGS. 2B and 2C) into the receiving chamber between the plate portion 27 and the lower plate 29 which is also horizontal. An end stop 30 extending parallel to the conveyor track limits movement of the insert in the feed direction. The plates of the cassette 25 are supported in end frames (not shown) but the lower plate 29 is secured only at its upstream end. A slot 28 extends along the lower plate 29 to allow the pusher elements to traverse the interior of the cassette.

An insert 20 resting on the lower plate 29 free of the eject rollers 21 (FIG. 2D) will be engaged by the next pusher element, which protrudes into the cassette through the slot 28, so as to be removed from the cassette onto the work surface or onto one or more inserts already being moved by the pusher elements. The insert or stack of inserts is carried by the pusher element to beneath the lower plate of the cassette 25 of the next feeder 7 downstream, from which a further insert may be removed.

At the insert station 6, the assembled stack of inserts 20 is carried by the second conveyor 2 to an end position defined by appropriatly positioned stop means from which the stack is moved laterally into an opened envelope carried to the insert station by the first conveyor 1.

Referring now to the conveyor 1, this has spaced conveyor chain loops 35 (FIG. 6) having extending across between them supports for clamps 37 extending upwardly through a slot in the work surface to engage the leading edges of respective envelopes 40. Fixed cams or ramps beneath the work surface act on the clamps to open them or to allow them to be closed by respective springs, so as to release or grip the envelopes as these are carried successively along the conveyor track from the supply stack located in the holder 4. The envelopes are clamped at their leading edges as they move onto the conveyor track, but are released at the insert station 6. They are again clampingly engaged after loading and released after they have moved past the moistener 9.

Figure 3A:
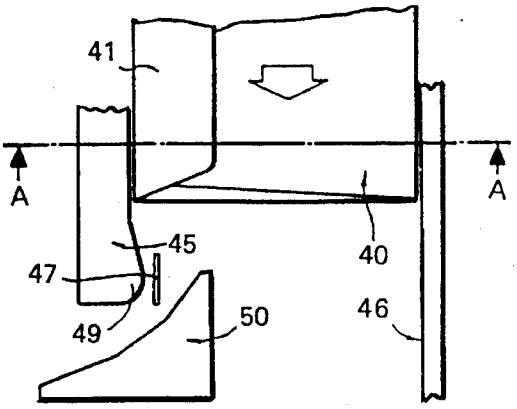
FIG. 3A is a schematic plan view of an envelope opening station included in the apparatus.
Figure 3B:
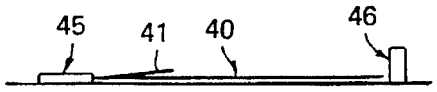
FIG. 3B is a sectional view taken on the line A—A of 3A.
Figure 3C:
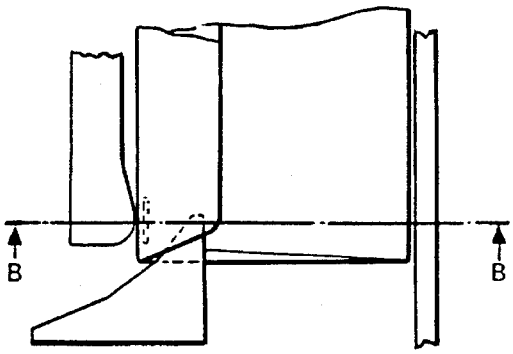
FIGS. 3C and 3E are views similar to that of FIG. 3A but showing successively later stages of an envelope opening operation.
Figure 3D:
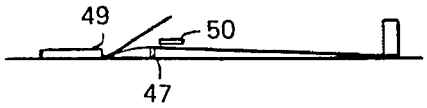
FIGS. 3D and 3F are cross-sectional views taken on the lines B—B and C—C of FIGS. 3C and 3E respectively.
Figure 3E:
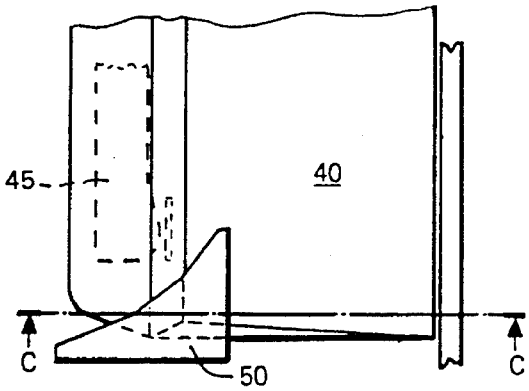
Figure 3F:
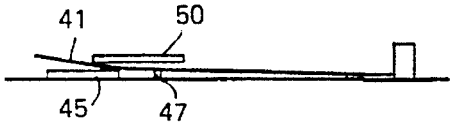

At the opening station 5 (FIGS. 3A–3F), the envelopes 40 are opened, that is, the flap 41 of each envelope is turned through 180° so as to be aligned with the main panel of the envelope from which it extends. This movement is effected by static apparatus means, only movement of the envelope by the conveyor 1 being necessary. The station 5 accordingly comprises a member 45 providing a longitudinally extending groove, into which is moved the edged of the envelopes at which the flap is joined to the main panel, and a back stop 46 preventing lateral movement of the envelope away from the member 45 (FIGS. 3A and 3B). As appears from FIGS. 3C and 3D, an upwardly projecting ridge 47, which is ramped or inclined upwardly in the feed direction, and a converging downstream end portion 49 of the grooved member 45 cause the envelope to buckle slightly upwardly. An effect of this buckling is to cause the flap 41 to turn upwardly so that as the envelope advances, a ploughshare member 50 positioned downstream of the member 45 can enter between the flap and the main body of the envelope. The ploughshare member 50 is shaped to continue the opening movement as the envelope advances until the envelope is in the fully open position, in which condition it reaches the insert station 6 where it is halted in registration with the stack of inserts 20 brought to the station by the conveyor 2.

Before the insert stack is moved into the envelope 40, a plurality of cam-driven envelope lifters (not shown) is rotated about an axis extending parallel to a length of the envelope, to bring the free ends of the lifters, which comprise curved blades, between the front and back panels of the envelope so as to space these apart to facilitate entry of the insert stack.

Figure 5A:
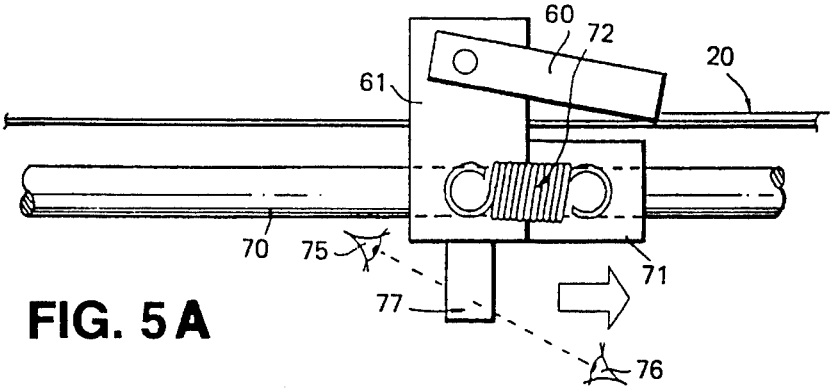
FIG. 5A is a schematic side view of an insert pusher device included in the apparatus of FIG. 1 associated with a fault detecting device.

The stack of inserts is moved laterally into the envelope by a plurality of kicker or pusher members 60 (FIGS. 5A and 5B) carried by a driven support 61 projecting upwardly through slots in the work surface. The pusher members 60 engage the edge of the insert 20 or the insert stack remote from the envelope and push the insert into the envelope 40 over its flap 41 and beneath the curved lifters.

In accordance with the invention, two separate means are provided for detecting failure of the insert or insert stack to enter the envelope.

Figure 4A:
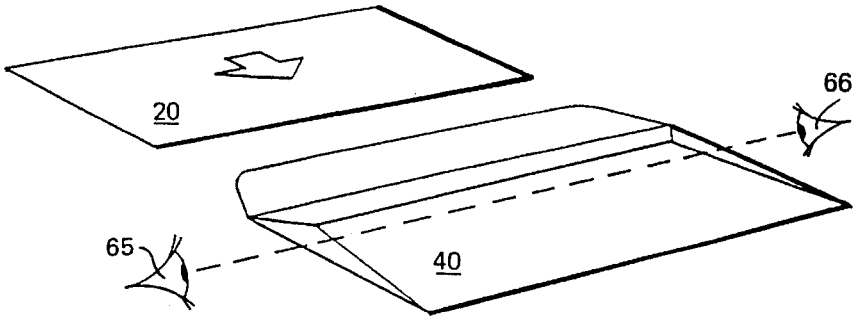
FIG. 4A is a schematic perspective view of an insert ready to be moved into an open envelope in the apparatus of the invention, to illustrate the functioning of a fault detection device in accordance with the invention.
Figure 4B:
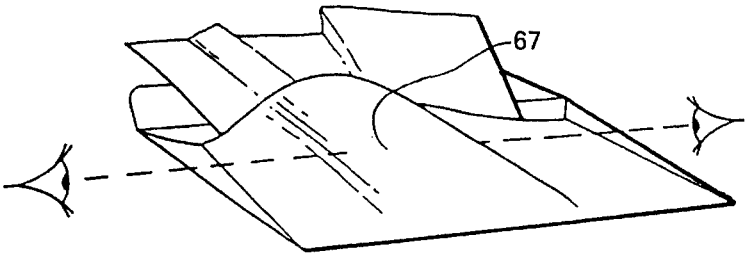
FIG. 4B is a view similar to that of FIG. 4A but showing how the device operates in the event of a fault.

A first detector means (FIGS. 4A and 4B) comprises an infrared source 65 and detector 66 positioned so that the infrared radiation beam between them extends lengthwise and directly over the envelope. Any failure, of the insert or inserts to enter the envelope will cause an upward buckling of the inserts and the envelope upper panel, which will interrupt the beam as indicated at 67 (FIG. 4B). Any such beam interruption is sensed so as to generate signals operative to stop the apparatus and to signal the need for it to be cleared before operation can be recommenced.

Figure 5B:
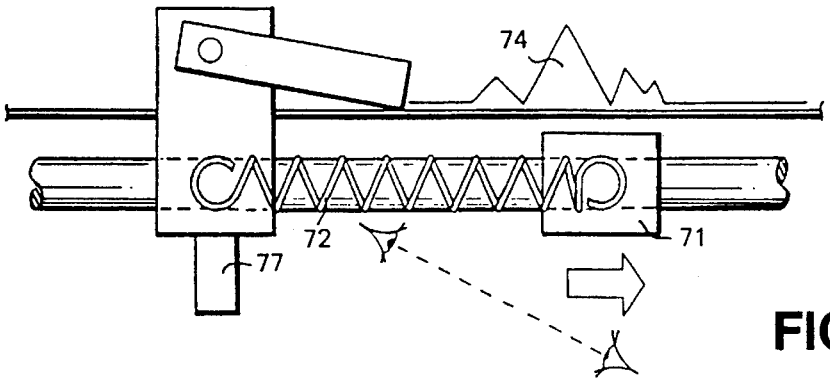
FIG. 5B is a view similar to that of FIG. 5A but showing how the detector device operates in the event of a fault.

The second detector means is associated with the drive arrangements for the insert station pusher members 60. The pusher member support 61 is reciprocably guided on a rod 70 extending in the direction of insert movement and located beneath the work surface of the equipment and is driven by way of a drive member 71 also slidably guided on the rod. The drive in the insert direction is applied from the drive member 71 to the support member 61 by way of a constant force tension spring 72 having its ends connected to the respective members. If there is any defect in the entry of the insert stack into the envelope, the support member will be held back by the buckled insert stack 74. The drive member 71 is able to advance by extension of the spring 72 (FIG. 5B). An infrared source 75 directs a radiation beam to a detector 76 at a position such that the beam is interrupted by an interrupter portion 77 of the support member 61 when this reaches the end of its normal insert stroke.

If the support member interrupter portion is not located by interruption of the beam at the expected time, signals are again generated by which the machine is stopped and an alarm is energised.

The loaded envelope is now again clamped by the conveyor clamp element and carried from the insert station beyond it by the first conveyor to the moistener 9 at which moisture supplied from a reservoir topped up by a peristaltic pump from a main supply is applied to the flap which still extends away from the body of the envelope. The flap is then turned over back to its original position overlying the main body of the envelope at the closer 10 and pressure is applied to effect good adhesion, by means of a sealing roller the rotational axis of which is inclined to the direction of movement of the envelope so as to prevent puckering of the flap on the envelope body. The envelope is released from the guide clamp at this point and is moved outwardly of the apparatus into the chute 11 or other receptacle by being pushed by the next upstream clamp element 37.

Figure 6A:
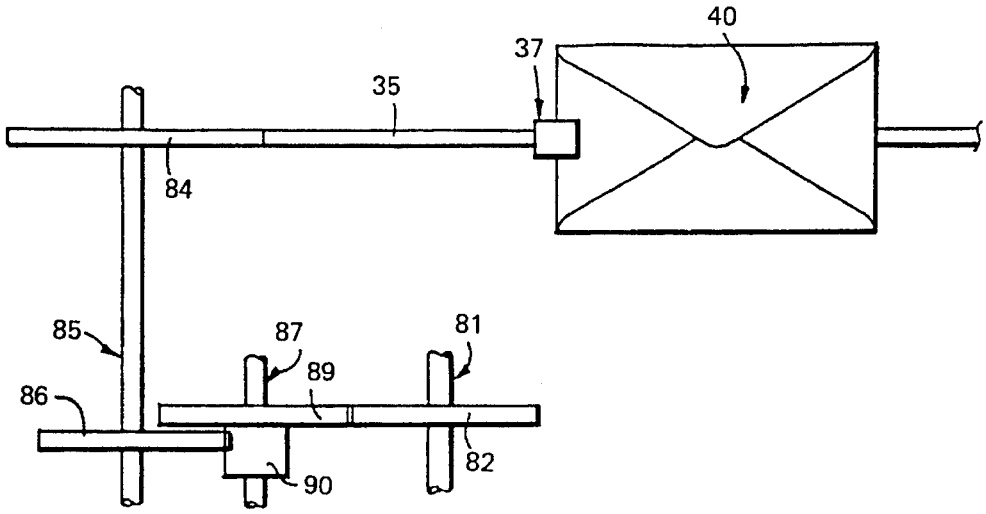
FIG. 6A is a schematic plan view of a drive device for an envelope conveyor included in the appartus of FIG. 1.
Figure 6B:
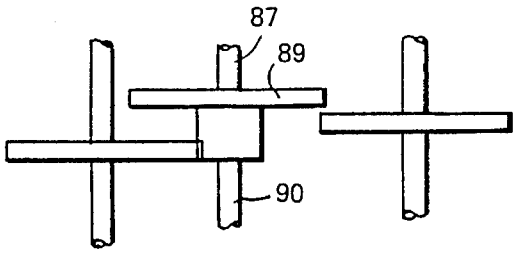
FIG. 6B is a partial view similar to that of FIG. 6A but showing the drive mechanism in a different position.
Figure 6C:
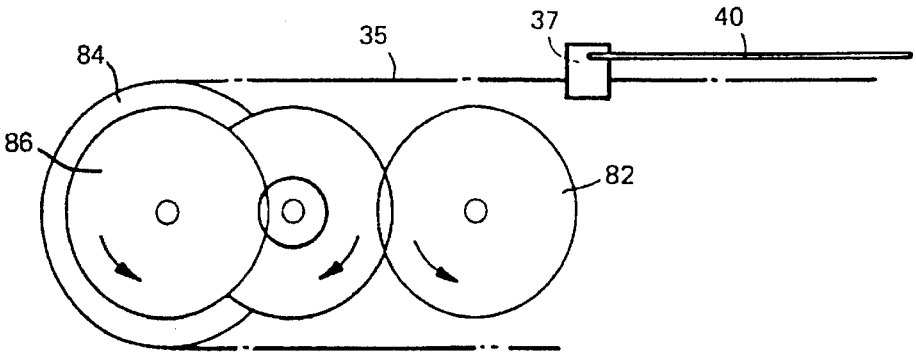
FIG. 6C is a side view of the drive mechanism of FIGS. 6A and 6B.

As shown in FIGS. 6A, 6B and 6C, the apparatus incorporates means whereby it can be readily adjusted for handling envelopes of different lengths. The adjustment device comprises a gear train including an input gear 82 secured to a shaft 81 driven by a motor through a clutch (not shown). The conveyor chain 35 is entrained around a sprocket 84 on a shaft 85 to which is secured the output gear 86 of the gear train. Between the output and input gears, an idler shaft 87 mounts a first gear 89 meshing with the input gear 82 and a pinion 90, of smaller diameter and of extended axial length, meshing with the output gear 86. In the normal drive position shown in FIG. 6A, the motor drive is applied to the sprocket 84, at a reduced rotational speed dependent on the relative diameters of the pinion 90 and the gear 86.

When it is desired to adjust the position of the clamps 37 relative to the rest of the apparatus, the idler shaft 87 is moved manually as shown in FIG. 6B to disengage the gear 89 from the gear 82. The conveyor chain 35 is not now driven, but the motor drive continues to be applied to the rest of the apparatus. When the apparatus has reached an appropriate condition relative to the clamps 37, the idler 87 is moved back again to the position of FIG. 6A and normal apparatus operation continues.

It will be evident that the invention can be carried into effect in a variety of ways other than as described and illustrated.

I claim:

1. An apparatus for opening envelopes, each envelope having a flap portion folded on a fold line to overlie a main portion of said envelope, said apparatus comprising:

a conveyor adapted to convey said envelopes along a conveyor path with said fold lines parallel to the direction of movement of said conveyor, means on said conveyor path adapted to distort each envelope so that said flap portion thereof is hinged upwardly from said main portion thereof, said distortion means comprising a projection extending adjacent said fold lines of said envelopes, a first guide member restraining upward movement of said envelopes at said fold line, and a second guide member restraining lateral movement of said envelopes away from said first guide member, and means downstream of said distorting means on said conveyor path and adapted to enter between said flap portion and said main portion of each envelope to bring said flap portion and said main portion substantially into co-planar alignment.

2. The apparatus of claim 1 wherein said projection comprises a ridge inclined upwardly in the direction of conveyor movement.

3. The apparatus of claim 1 wherein said first guide member has a slot for receiving each said envelope at the region of said fold line, said slot extending parallel to the direction of movement of said conveyor at the upstream end of said slot and being shaped to converge towards said second guide member adjacent said projection.

4. The apparatus of claim 1 wherein said distorting means comprises a ploughshare member of which the upstream end is adjacent the projection.

5. An apparatus for opening an envelope, the envelope having a flap secured to the body of the envelope at a fold line extending parallel to an end edge of the envelope body, said apparatus comprising:

distortion means providing opposed convergent surfaces, and conveyor means for relatively moving said envelope and said distortion means with said fold line and end edge engaged with said opposed convergent surfaces respectively whereby said envelope body bends to effect angular separation of said flap from said body about said fold line.

6. The apparatus of claim 5 further comprising flap turning means having a shaped edge, said conveyor means relatively moving said flap turning means and said envelope with said angularly separated flap and body, said shaped edge engaging said flap on the side thereof adjacent said body and progressively increasing said angular separation between said flap and said body.

7. The apparatus of claim 5 wherein said distortion means further comprises ramp means between said opposed convergent surfaces, said ramp means assisting bending of said envelope body.

* * * * *